US012429313B2

(12) United States Patent
Moyer

(10) Patent No.: US 12,429,313 B2
(45) Date of Patent: Sep. 30, 2025

(54) MULTI-TARGET APPARATUS

(71) Applicant: James Moyer, Palmyra, VA (US)

(72) Inventor: James Moyer, Palmyra, VA (US)

( * ) Notice: Subject to any disclaimer, the term of this patent is extended or adjusted under 35 U.S.C. 154(b) by 521 days.

(21) Appl. No.: 18/064,876

(22) Filed: Dec. 12, 2022

(65) Prior Publication Data

US 2023/0184520 A1 Jun. 15, 2023

Related U.S. Application Data

(60) Provisional application No. 63/288,238, filed on Dec. 10, 2021.

(51) Int. Cl.
*F41J 1/10* (2006.01)
*F41J 7/04* (2006.01)

(52) U.S. Cl.
CPC .. *F41J 1/10* (2013.01); *F41J 7/04* (2013.01)

(58) Field of Classification Search
CPC ..... F41J 1/10; F41J 7/04; F41J 9/00; F41J 13/02
See application file for complete search history.

(56) References Cited

U.S. PATENT DOCUMENTS

| | | | | |
|---|---|---|---|---|
| 1,098,255 | A * | 5/1914 | Harper | F41J 7/04 273/392 |
| 10,288,389 | B1 * | 5/2019 | Wadsworth | F41J 7/06 |
| 2005/0116421 | A1 * | 6/2005 | Kuosa | F41J 7/04 273/371 |
| 2011/0163503 | A1 * | 7/2011 | Townsend | F41J 7/04 273/355 |
| 2014/0070492 | A1 * | 3/2014 | Murphy | F41J 13/00 273/394 |

* cited by examiner

*Primary Examiner* — Michael D Dennis
(74) *Attorney, Agent, or Firm* — Kimberly O Snead

(57) ABSTRACT

The invention discloses an apparatus that enables a user to shoot multiple targets, both stationary and moving, consisting of a structure having three sides, optionally enclosed, and an open side to form an interior supporting primary targets and having a top supporting secondary targets. Primary targets, rotatably affixed to a target bar spanning the open side, have projections on the back which, upon impact, rotate to impact a secondary target positioned on the top of the apparatus. The impact uses the kinetic energy to launch the secondary target contained within a secondary target holder positioned on the top of the apparatus and open to the interior. The projections are dimensioned to have sufficient contact to launch the secondary target without getting embedded in the secondary target holder. The projection can be either permanently or removably affixed to the back of the targets and can, when removable, permit weight variations.

20 Claims, 11 Drawing Sheets

MULTI-TARGET APPARATUS

FIELD OF THE INVENTION

The target apparatus disclosed herein is an open-front structure having sufficient strength to resist distortion when struck with a projectile and providing targets serving multiple purposes.

BACKGROUND OF THE INVENTION

Rifle or pistol target shooting is a popular hobby for civilians and a necessity for law enforcement personnel. Indoor and outdoor shooting ranges are available in many locations, but marksmen can also set up their own personal target practice areas. Personal target practice areas often utilize targets with limited functionality, thus limiting the user's experience and practice options.

SUMMARY OF THE INVENTION

An open-front, multiple target apparatus configured to securely withstand impact by a projectile without movement. The apparatus has a frame with a plurality of legs connected by a plurality of supports to form an interior surrounded by three sides. The second side is rigidly connected to the first and third sides with a target bar suspended from the frame between the first and third sides. The first, second and third sides can be covered to prevent projectiles from exiting the interior. The target bar is configured to support at least one primary target. An optional rear deflector, positioned at an angle, is secured to, and positioned between the first and third sides at an angle to direct projectiles downward.

A top, rigidly connected to at least the first and third sides, is configured to support at least one secondary target. In situations where additional impact resistance is required, a back side can be secured between the first and third sides and the top further connected thereto. An optional angled top deflector, usually positioned between the secondary target holder and the open front, is securely mounted on the top to deflect projectiles downward. Deflector sides provide additional support and impact resistance.

The target unit(s), each comprises a primary target, with a front; back and a shaft, is connected to the target bar with the shaft rotatably connecting the primary target to the target bar. The secondary target holder, or holders, has sides and open ends with one of the ends being open to the interior. At least one of the primary targets has a projection securely connected to the back of the target; the projection being dimensioned to contact the open end of a secondary target holder.

Upon impact of the primary target by a projectile the shaft is rotated to bring the projection in forceable contact with the secondary target within the second target holder. The kinetic energy from the impact launches the secondary target as a moving target.

The projections can be permanently affixed to the back of the primary target or removably secured through use of bolts. When removable projections are used the weights can be varied to provide different responses to the impact or to accommodate higher or lower velocity projectiles.

BRIEF DESCRIPTION OF THE DRAWINGS

The objects, features, advantages, and aspects of the present invention can be better understood with reference to the following detailed description of the preferred embodiments when read in conjunction with the appended drawing figures.

DETAILED DESCRIPTION OF THE INVENTION

Parts List

Figure 1:
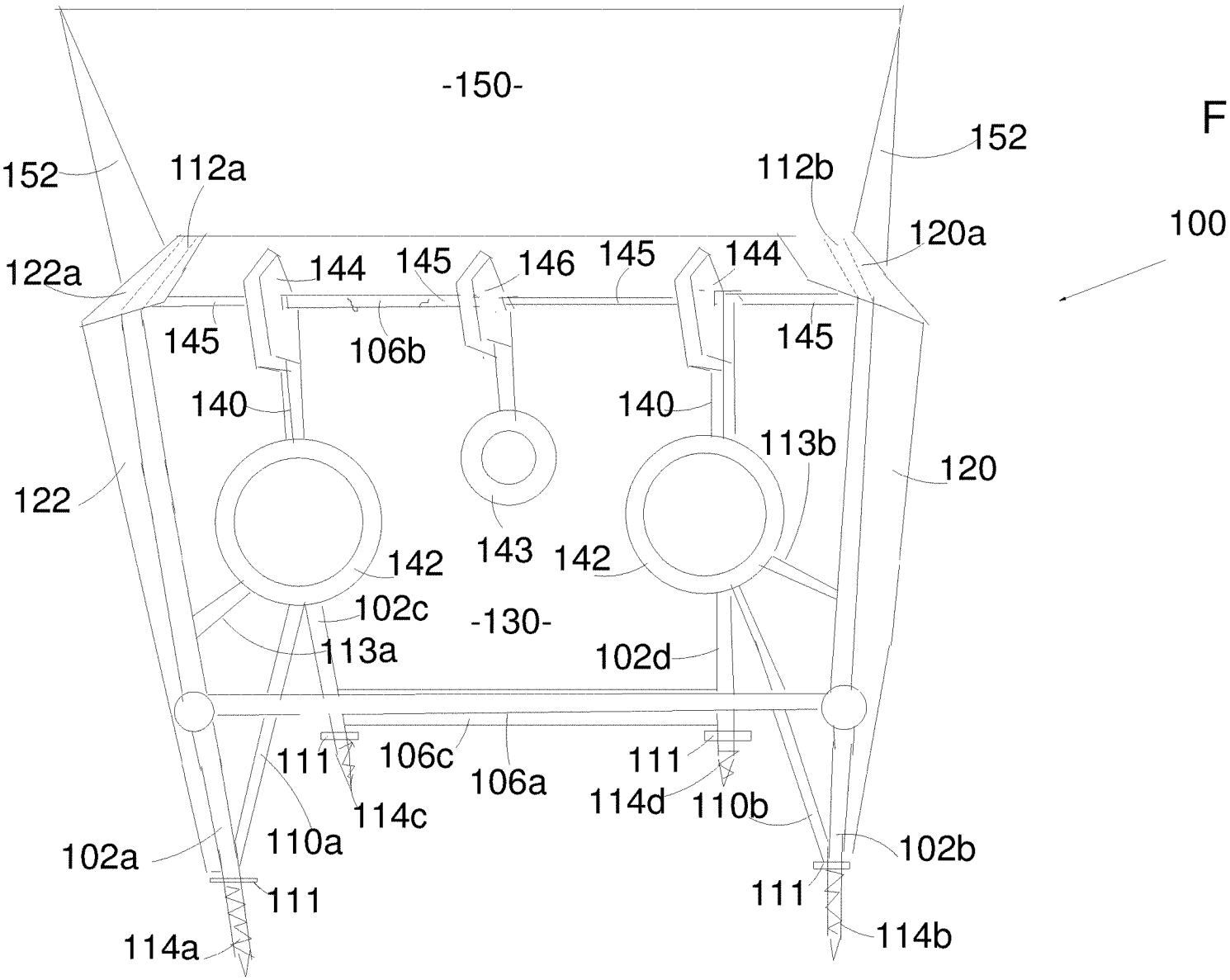
FIG. 1 is a front view of an example shielded target apparatus, in accordance with the present invention.

100 multi-target apparatus
102*a*/102*b* front leveling legs
102*c*/102*d* rear leveling legs
106*a* front bottom cross bar
106*b* front top cross bar
106*c* rear bottom cross bar
106*d* rear top cross bar
110*a*/110*b* bottom side bars
111 leveling nuts
112*a*/112*b* top side bars
113*a*/113*b* middle side bars
114*a*/114*b* front threaded sections
114*c*/114*d* rear threaded sections
120 metal side
120*a* metal side lip
122 metal side
122*a* metal side lip
130 angled rear deflector
140 pendulum shaft
142 primary targets with projection

143 primary target without projection
144 connector
145 spacers
146 connector
148 projection
150 angled top deflector
152 top deflector sides
180 top
182 secondary target holder
182*a* lip
184 secondary target holder opening
310 pendulum
312 target
314 projection
316 path
320 secondary target holder
322 secondary target
324 lip
326 holder opening
724 metal back
720 Side plate
780 top plate
702*d* rear leg
1000 unenclosed apparatus
1002 legs
1004 threaded leg sections
1006 cross bar
1008 top shield
1010 leveling nuts
1024 back shield
1040 pendulum
1042 single target
1100 apparatus
1106*a* cross bar
1140 pendulum
1142 primary targets
1160 multi-piece target
1162 target face
1164 interchangeable projection
1166 bolt
1168 bolt head
1170 threaded receiving channel
1172 sunken entry
1174 threaded projection channel
1192 welded bolt head
1194 welded target face
2010 interchangeable projection
2012 rod/bolt
2014 nut
2016 target face
2018 channel The disclosed target apparatus affords a more comprehensive shooting experience for users by providing both stationary and moving targets through the use of the kinetic energy of a fired projectile. A projectile striking the primary target rotates the target to strike and launch a secondary target such as a soda can, or similar item, into the air upon impact of the primary target with the secondary target. When struck from the front by a projectile, the primary target forcibly moves backwards and upwards via a pendulum mechanism abruptly causing a projection on the rear of the target to strike the bottom of the secondary target within a secondary target holder. This impact imparts kinetic energy to the secondary target launching it from the holder into the air where the secondary target becomes a moving target for the shooter.

For safety purposes, the secondary target holder and areas behind the apparatus are preferably shielded from inaccurate projectiles by solid metal plates that deflect off-target projectiles into the ground. This can be accomplished through the use of optional rear and top deflectors, enclosing the apparatus with a metal back and/or sides, backing the apparatus against a berm or hill, or placing one or more apparatuses in an independent enclosure such as a shooting range.

Additionally, primary targets of various weights can be used to accommodate different handgun calibers as well as a variety of secondary targets such as both full and empty cans and specialized secondary targets. The disclosed device can also be constructed with multiple primary targets and multiple secondary target holders to facilitate multiple target launches.

The example apparatuses illustrated herein use four legs and are designed to be independent from another structure. This design would be the most often used by individuals and shooting ranges. However, the illustrated designs should in no way limit or eliminate an apparatus that is part of a larger and/or non-movable structure, such as the interior of a large indoor shooting range. The critical features of the disclosed target apparatus are that a primary target rotates to contact a secondary target, that the secondary target is free to be expelled from its holder, and that safety is adhered to by prevention of ricochets.

The target apparatus of the present invention is an open-front structure having a top and a sturdy frame with legs and supports that can withstand projectile impact with little to no movement. The frame supports at least one primary target while the top supports at least one corresponding secondary target. The frame includes a target bar or similar component to support a target unit within the structure creating a pendulum mechanism. The target unit includes a shaft with the primary target at one end and a connector at the other end that attaches the unit to the bar. The top supports the secondary target within a secondary target holder.

FIG. 1 illustrates the front view of an example multi-target apparatus 100 showing a frame preferably having front leveling legs 102*a* and 102*b* and rear leveling legs 102*c* and 102*d* connected by front and rear bottom cross bars 106*a* and 106*c*, front and rear top cross bars 106*b* and 106*d*, bottom side bars 110*a* and 110*b*, top side bars 112*a* and 112*b*, and middle side bars 113*a* and 113*b* to create an open-front structure having sufficient strength to resist distortion when struck with a projectile. Other frame configurations providing sufficient structural strength could also be used.

In the example configuration of FIG. 1, the rear leveling legs 102*c* and 102*d* are connected by bottom cross bar 106*a*. Each of the front legs 102*a* and 102*b* as well as the rear leveling legs 102*c* and 102*d* has a threaded section 114*a* and 114*b* and 114*c* and 114*d* onto which leveling nuts 111 are threaded. The front threaded sections 114*a* and 114*b* as well as the rear threaded sections 114*c* and 114*d* must have sufficient length to secure the target apparatus into the ground and prevent inadvertent movement during use. The threaded front leg 102*a* is connected to the threaded back leg 102*c* by top side bar 112*a*, middle side bar 113*a*, and bottom side bar 110*a*. On the opposite side the threaded front leg 102*b* is connected to the threaded back leg 102*d* by top side bar 112*b*, middle side bar 113*b*, and bottom side bar 110*b*. Once the connecting cross bars and side bars are leveled, the threaded front leg sections 114*a* and 114*b* and threaded rear leg sections 114*c* and 114*d* are sunk at a depth to prevent movement and leveled, and the leveling nuts 111 are rotated to bring them into contact with the ground. Alternatively, the leveling nuts 111 can be rotated to the correct length and the legs then sunk into the ground.

Figure 10:
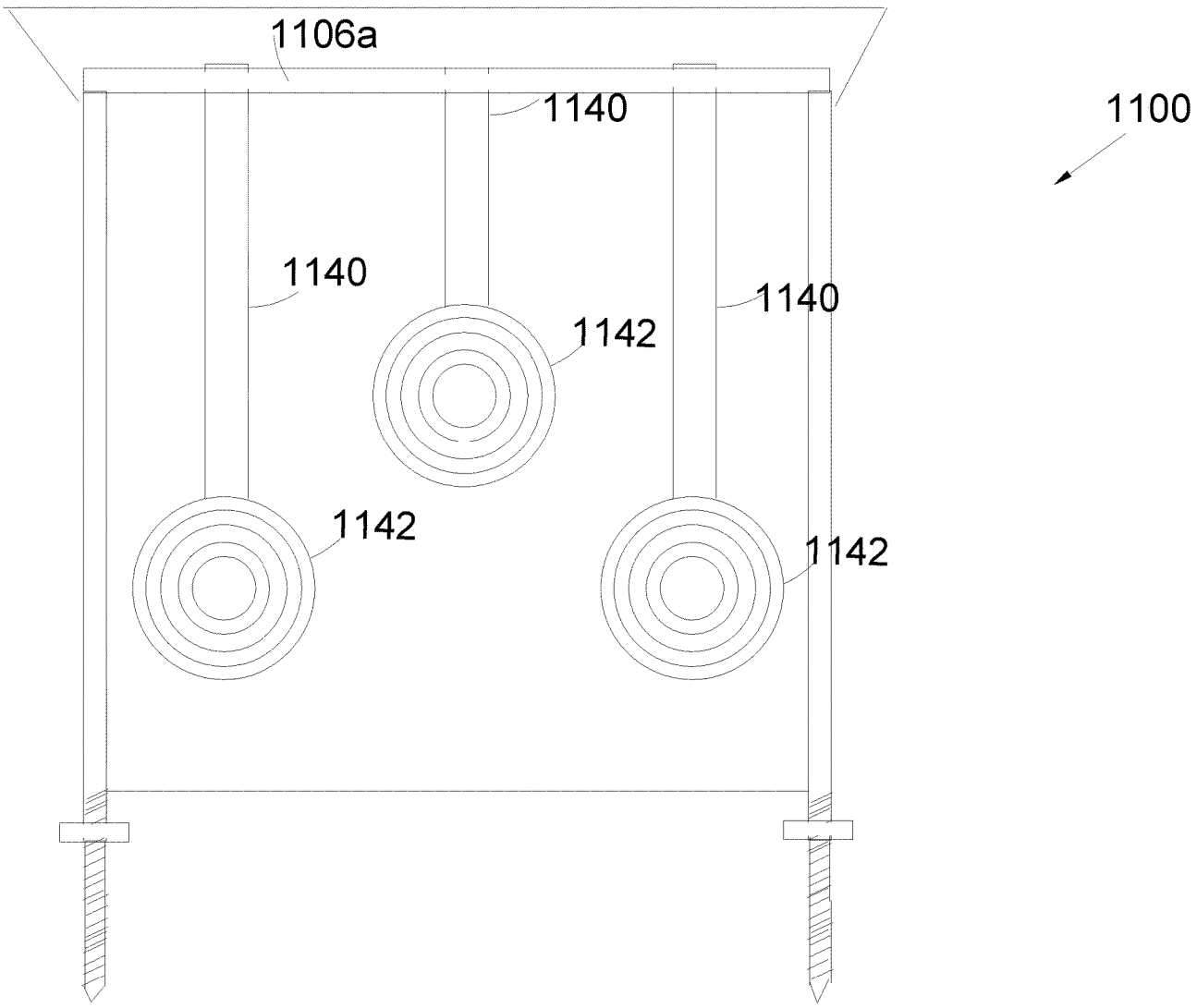
FIG. 10 Figure is an example multi-target, unshielded apparatus in accordance with the present invention.
Figure 11:
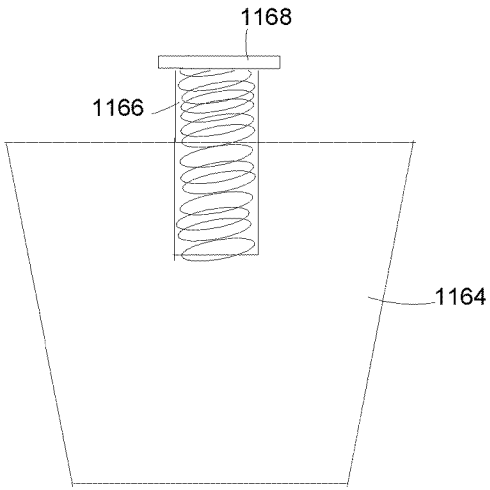
FIG. 11 is a side view of a replaceable projection in accordance with the present invention.

As shown in FIG. 1, the sides created by the space between the front leg 102*a* and rear leg 102*c* and front leg 102*b* and rear leg 102*d* are preferably covered with a strong, impact-resistant material, preferably metal, to create metal sides 120 and 122. Metal sides provide an enclosed structure to give additional support and to prevent projectile ricochet. However, as illustrated in FIGS. 10 and 11, this space can be left open. When metal sides 120 and 122 are used, the tops of the sides 120 and 122 can be folded over to form lips 120*a* and 122*a*, as illustrated in the embodiment of FIG. 1.

The angled rear deflector 130 extends at an upward angle from at least one lower attachment point between the rear legs 102*c* and 102*d* to at least one upper attachment point between top side bars 112*a* and 112*b*. The angled rear deflector 130 is illustrated and described in more detail in FIG. 4.

Figure 2:
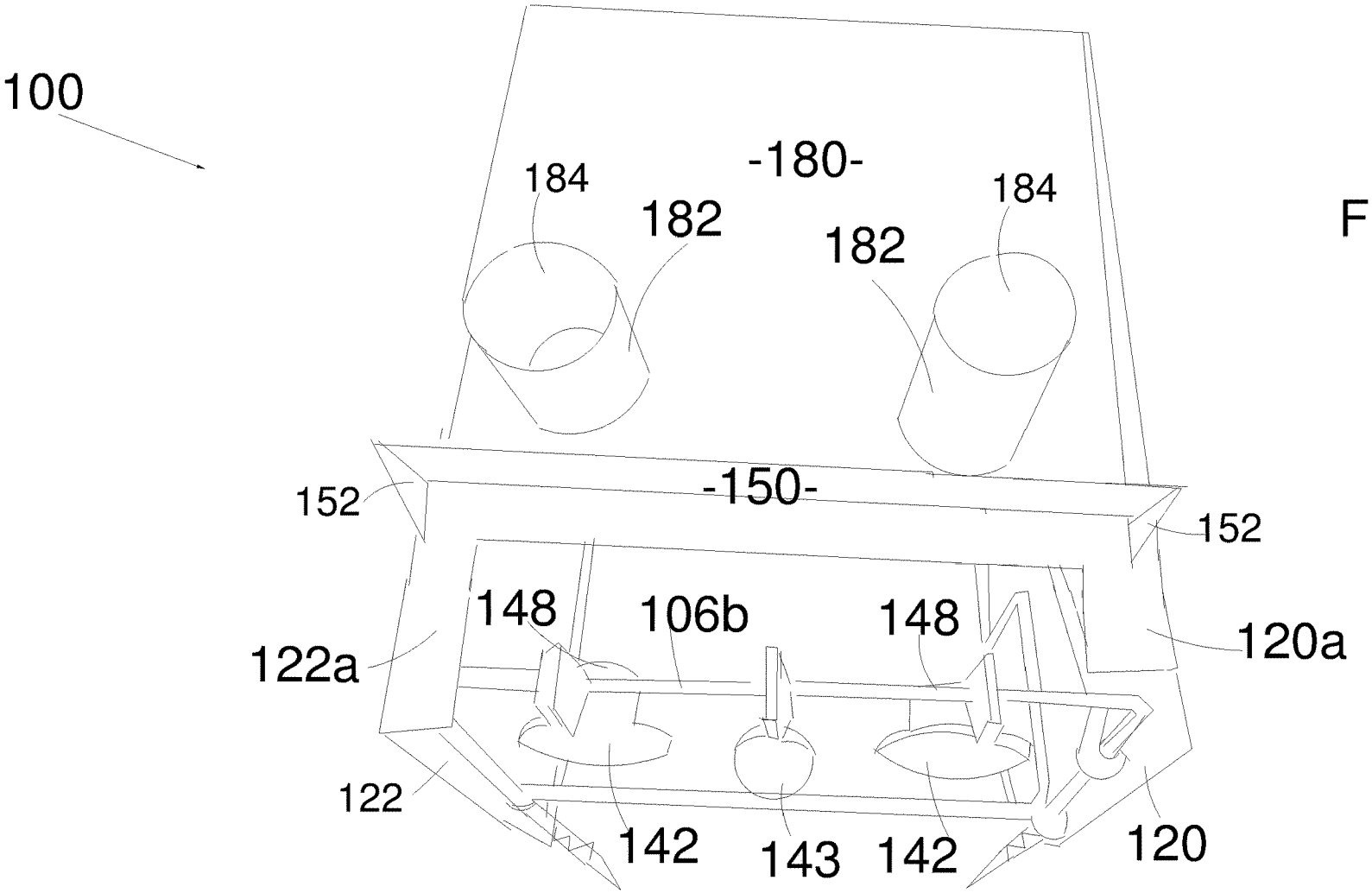
FIG. 2 is a perspective top view of the example shielded target apparatus of FIG. 1, in accordance with the invention.
Figure 9:
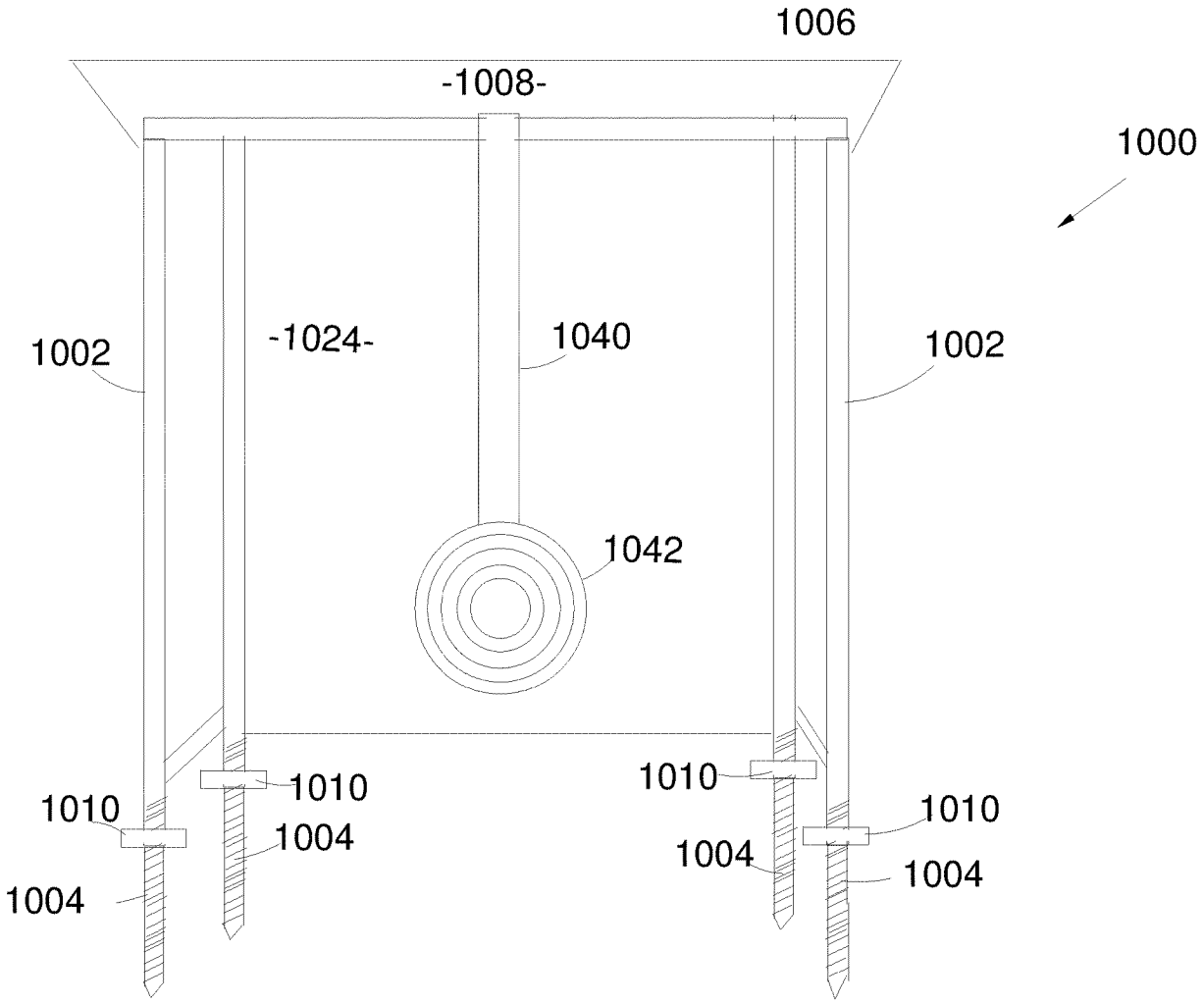
FIG. 9 is an example single target, unshielded apparatus in accordance with the present invention.

As shown in FIGS. 1 and 2, multiple primary targets 142 each have a circular or tapered, frustum-shaped projection 148 that extends out from the back of targets 142. Targets 142 are each rigidly attached to a pendulum shaft 140 that is rigidly attached to a connector 144 to form a target unit. The unit is connected to the cross bar 106*b* at connector 144 and maintained at a predetermined distance apart by spacers 145, thus creating a pendulum mechanism that allows for rotation of the targets 142. The configuration of the pendulum mechanism must allow targets 142 to freely rotate 90 degrees or greater to enable the projection 148 to eject a secondary target upon impact as discussed in more detail below. In the preferred embodiment, pendulum shaft 140 is pivotally connected at connector 144 to cross bar 106*b*, thus allowing connector 144 to rotate around a stationary cross bar 106*b*. Alternatively, in some instances, based on end use, a connector 144 can be welded to cross bar 106*b* and the cross bar enabled to rotate. This design would be best when used with a single primary target design, such as illustrated in FIG. 9, since all targets would rotate upon impact.

In the preferred embodiment a connector 144, pendulum shaft 140, and target 142 are a single molded piece made from steel or a material of at least equivalent strength. Alternatively, the elements can be connected to one another through welding or other means; however, it must be ensured that the connections can withstand the pressure applied by repeated projectile impacts.

Figure 3:
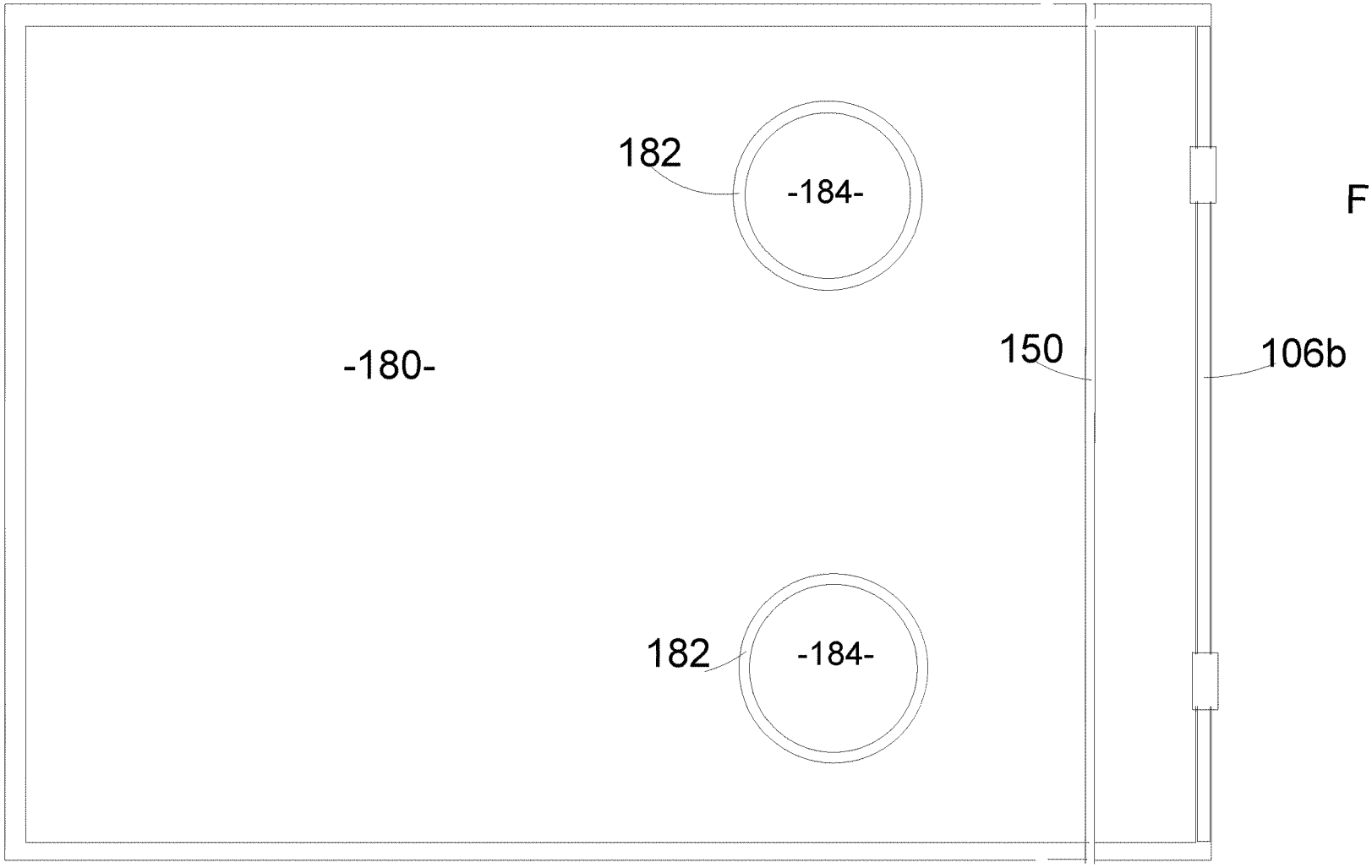
FIG. 3 is a top view of the shielded target apparatus of FIG. 1, in accordance with the present invention.

As illustrated in FIGS. 2 and 3, a top 180 spans a substantial portion of the space created between top side bars 112*a* and 112*b* and/or metal sides 120 and 122 and the front and back top cross bars 106*b* and 106*d*. Top 180 supports secondary target holders 182 as well as an angled top deflector 150 with deflector sides 152. The top 180 can be of any rigid material, such as steel, which will support the impact from the targets 142 striking the underside of the secondary target holders 182 without damaging the apparatus 100. The primary support for the top 180 is the side top bars 106*a* and 106*c* and back top bar 106*b*, although alternative, or additional, support can be provided.

As seen in FIG. 2, the back of each target 142 has a circular or tapered, cone-shaped projection 148 that extends out from the target 142 a sufficient length to contact the secondary target with sufficient force to expel the target. For example, when using cans as secondary targets, the projection 148 extends about two inches from target 142. The configuration of the opening of the secondary target holder 182 must be compatible with the projection 148 to receive the projection 148 and expel the secondary target contained within the holder 182. The periphery of the projection 148 must be slightly less than the opening 184 between the lip 184*a* (FIG. 4) of the secondary target holder 182 to enable the projection 148 to contact the secondary target 322 (FIG. 6) with sufficient force and then rotate back to the start position without friction. Depending on end use preferences, the projection 148 can be molded as part of a solid target 142 or removable. In embodiments where the projection 148 is removable, as disclosed hereinafter, it can be exchanged for different projections of various weights to adjust for different velocity projectiles.

FIGS. 1 and 2 include two primary targets 142 and an additional primary target 143 which, as shown in FIG. 2, does not have a projection 148 as included in the targets 142. This configuration is an example of construction, and a projection 148 can be added to target 143, or the target 143 can be eliminated. Additional targets, with or without projection 148 can be added to a target apparatus depending on the end use.

Figure 4:
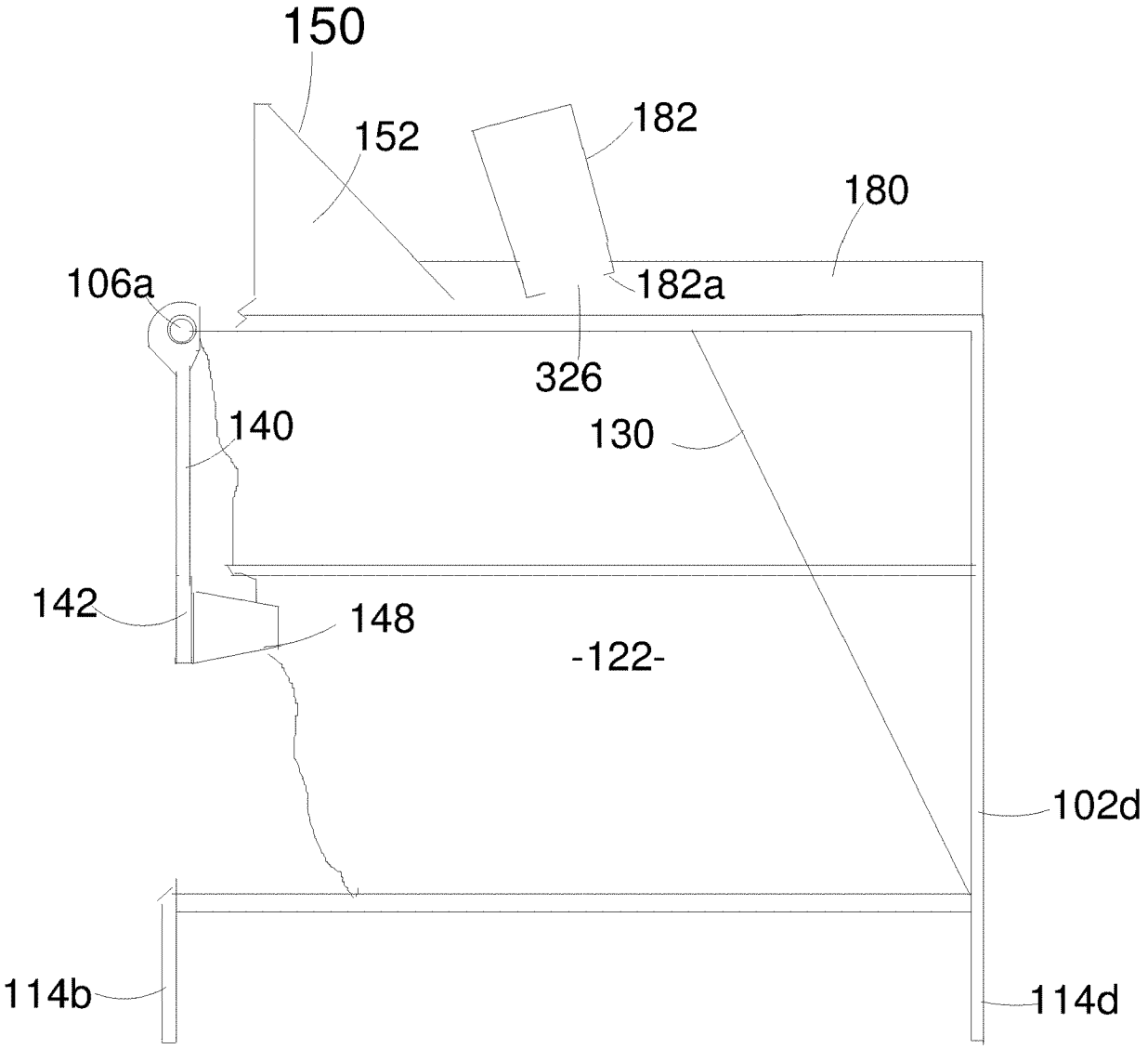
FIG. 4 is a cutaway side view of the example target apparatus of FIG. 1 showing the hidden frame and target in accordance with the present invention.

As clearly illustrated in FIGS. 1, 2 and 4, an angled U-shaped top angled deflector 150 is preferable supported by the top 180 and spaced a distance behind the front top support bar 106*b*. The spacing between the support bar 106*b* and the deflector 150 will be dependent upon the size of the apparatus and will be known by those skilled in the art. Deflector 150 generally has a height of about five (5) inches and can either be aligned with the sides 120 and 122 of the apparatus 100 or extend beyond the frame. The deflector sides 152 are preferably made of metal and angled to rest on the top 180 for support, as illustrated clearly in FIG. 2; however, they can be open as illustrated in FIGS. 9 and 10. If deflector sides 152 are not used, other means of support must be provided unless the device 100 is being used with bow and arrow or other low impact projectiles. The deflector 150 is angled down, toward the leveled sides 120 and 122 and top 180 of the apparatus 100 approximately 45 degrees as it is being used to prevent the projectiles from ricocheting back toward the user. Depending upon end use, the height of the deflector 150 and dimensions of the deflector sides 152 can be altered to better accommodate the projectiles being used.

The deflector 150 and the supporting sides 152 must be spaced a sufficient distance from the secondary target holder 182 so as to not interfere with the expulsion of the secondary target. The supporting sides 152 are preferably steel connected in a U shape to the deflector 150. The connection can be through welding or bending depending on manufacture's preference.

FIG. 4 illustrates a cutaway side view of the target apparatus 100 showing the leveling legs 102*b* and 102*d* with leveling legs 102*a* and 102*c* (not illustrated) completing the apparatus 100. Although the apparatus 100 illustrated in this Figure is enclosed with sides as noted above, a side as well as a portion of the framing has been removed from this figure to view the interior elements more clearly. The rear deflector 130 is also more clearly shown secured to the frame at an angle of at least 45 degrees or greater to force the projectiles downward toward the ground to prevent ricocheting.

Figure 16:
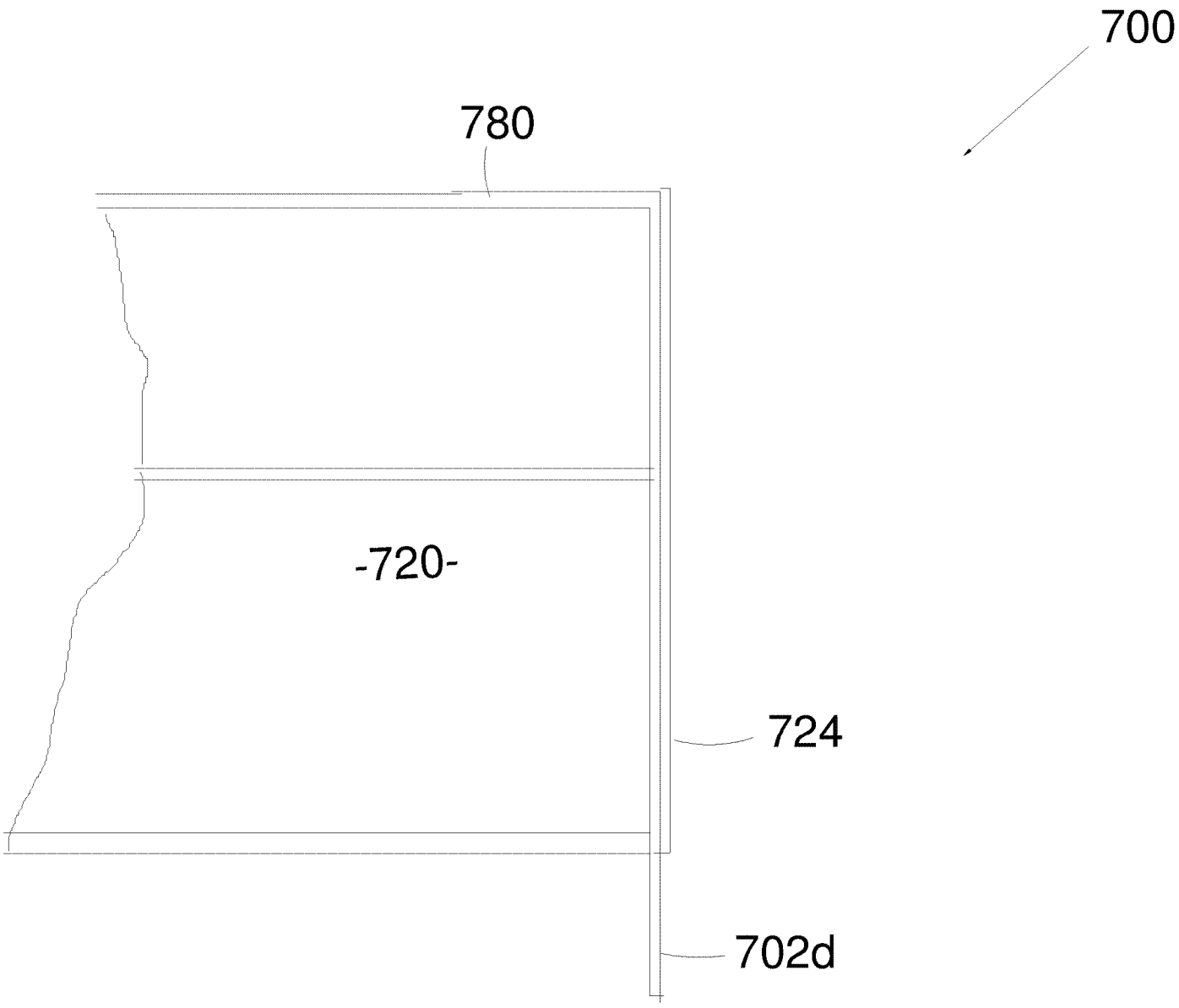
FIG. 16 is a cutaway side view of an alternate embodiment using a back plate.

FIG. 16 illustrates an alternate example frame for the apparatus 700 showing the top 780, side 720, and rear support leg 702*d*. In this example the angled rear deflector 130 has been eliminated and a back plate 724 used. The back plate 724 can be used in combination with the rear deflector 130 as additional reinforcement when required. The remaining elements of the apparatus 700 would be as described herein.

In FIG. 4, the pendulum shaft 140 can be seen extending from connector 144 in a freely swinging configuration around the top front bar 106*a* and supporting target 142 at its end. The projection 148 is positioned to contact the opening 326 of the secondary target holder 182 as it swings upward upon contact by a projectile. As illustrated the secondary target holder 182 in this embodiment is designed for a can and therefore extends from the top 180 a sufficient distance to support a can and has a lip 182*a*, or multiple stops, to prevent the can from falling through. If other secondary targets are used, it will be obvious to those skilled in the art to modify the secondary target holder accordingly.

In order for the secondary target to be expelled at an optimal angle, the secondary target holder 182 is tilted slightly forward about 2 degrees. The 2-degree angle serves to direct the launched secondary targets 322 (FIGS. 6-8) slightly towards the user to facilitate retrieval. This particular angle configuration is for user convenience, and the target holder can be angled at any degree as long as the angle does not cause the target to contact the deflector 150.

The secondary target holder 182 is positioned within the top 180 so that the impact of primary target hitting the secondary target is optimal for release of the secondary target. This positioning can be centered within top 180 or off-center with positioning adjustments made for the pendulum shaft 140 connection. Although the secondary target holder 182 is illustrated herein as round, it can be any configuration appropriate to the secondary targets. Additionally, although a solid top 180 is referred to, the top can consist of supports crisscrossing between the cross bars 106*a*, 106*b*, 106*c* and 106*d*.

In the illustrations of FIGS. 5-8 are examples of the interior of an apparatus whether enclosed or open. The pendulum 310, target 312, projection 314 and secondary target holder 320 and the direction taken by the pendulum 310 for expelling the secondary target are illustrated in more detail. In this example the projection 314 is square vs. the fulcrum configuration of the projection 148 in the prior figures. The configuration, angling, and dimensioning of the target, projection, and secondary target holder, along with the length of the pendulum are dependent upon the size of the apparatus, projectile being used, and available space. The optimal designs will be known to those skilled in the art.

Figure 6:
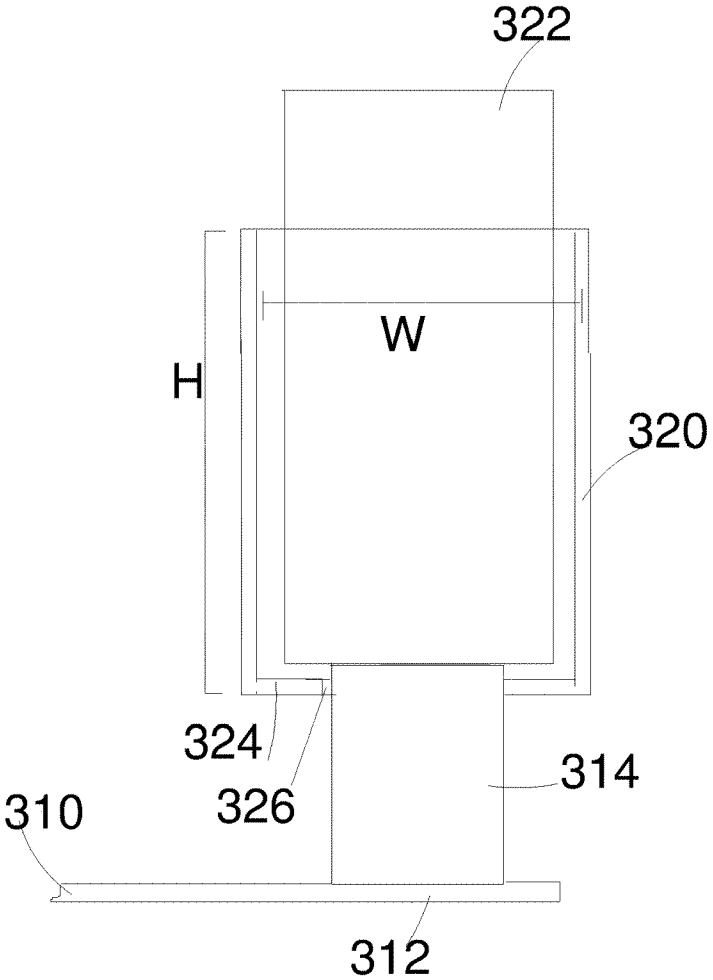
FIG. 6 is a cutaway view of the projection as it contacts the secondary target.
Figure 5:
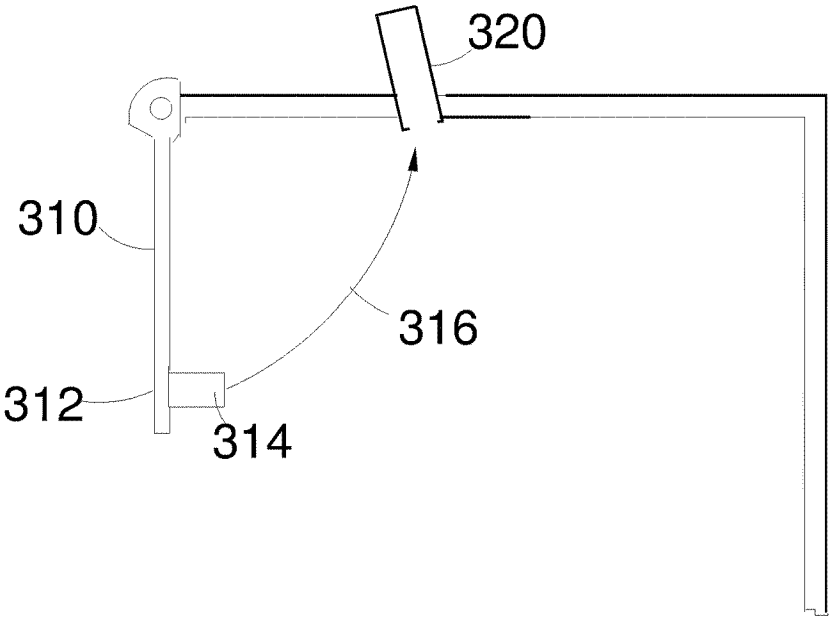
FIG. 5 is a side view illustrating the arc of the projection as it would contact the secondary target holder.

In FIG. 5, the path 316 of the projection 314 is illustrated where, once the target 312 is impacted by the projectile, the projection 314 swings up to contact the opening 326 of the secondary target holder 320. In FIG. 6, the target 312 has been struck and the pendulum 310 has swung up to place the projection 314 in contact with the secondary target 322. As can be seen, the secondary target 322, prior to be struck, is retained within the secondary target holder 320 and prevented from falling through the holder 320 by lip, or stops, 324.

Figure 8:
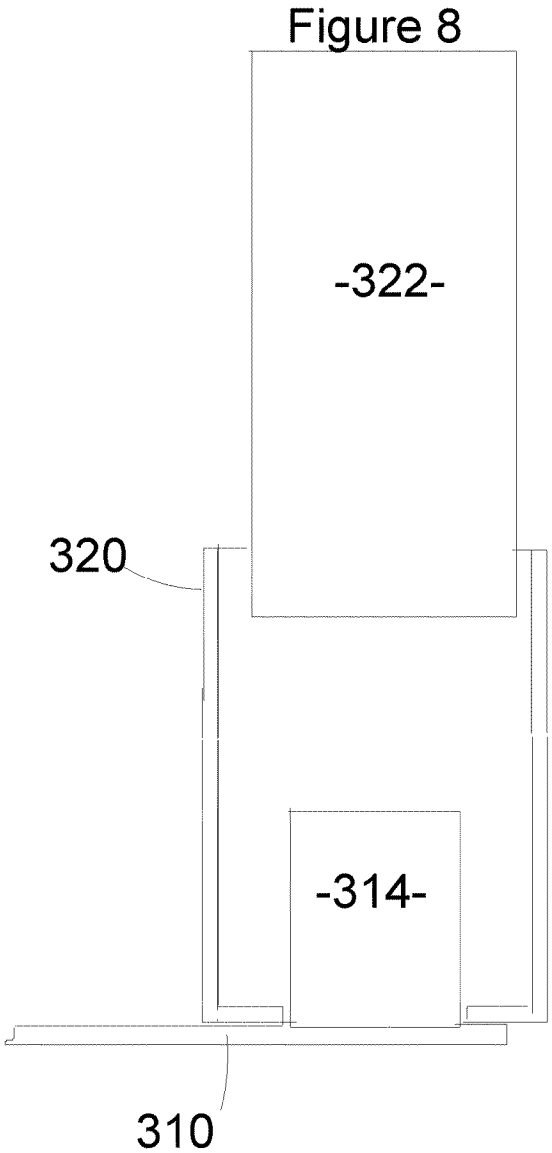
FIG. 8 is a cutaway view of FIGS. 6 and 7 with the projection having contacted and propelled the secondary target; in accordance with the present invention.
Figure 7:
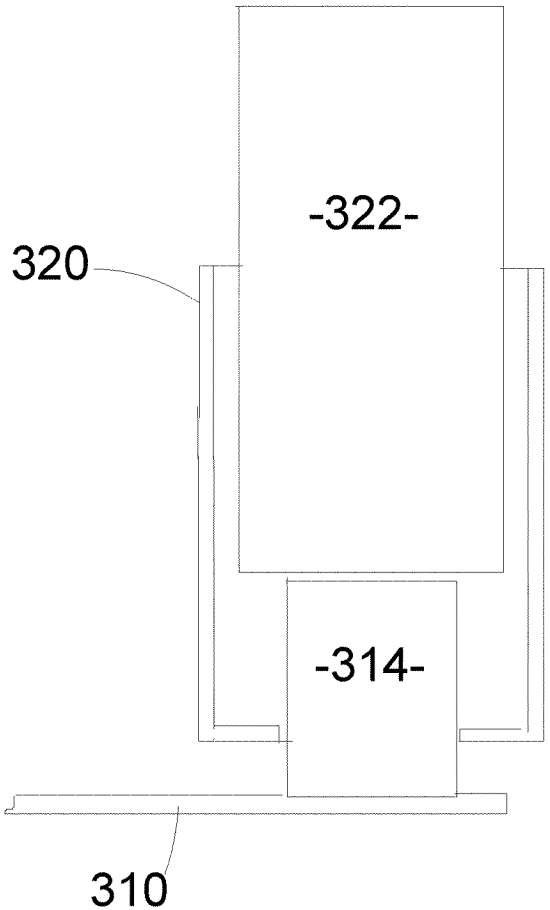
FIG. 7 is a cutaway view of FIG. 6 with the projection in partial contact with the secondary target.

The secondary target holders 320 have a height H and a width W sufficient to hold a secondary target 322 in a position to place the base of the secondary target 322 flush with the holder opening 326. For example, when cans are being used, the holder opening 326 would be approximately 2 inches with the secondary target holder 320 interior about 2⅛ inch. This would enable the projection 314 to contact the base of the can with the greatest impact. Other dimensioning, such as for clay pigeons, would be obvious to those skilled in the art. Additionally, although some secondary targets can be stacked others cannot and the dimensioning for stackable secondary targets would be obvious to those skilled in the art. In FIGS. 7 and 8, the secondary target 322 is illustrated in the sequence of exiting the secondary target holder 320 as the target 310 projection 314 strikes the secondary target 322, ejecting it from the secondary target holder 320.

FIG. 9 illustrates an unenclosed single target apparatus 1000 where, as it is not enclosed with sides, additional support may be required in the form of additional and/or thicker bars along the sides of the apparatus 1000. The optimal method of providing the required support will be dependent upon the end use, e.g., type and force of the projectile, surrounding area, etc. and will be known by those skilled in the art.

As with the apparatus 100, the unenclosed apparatus 1000 comprises legs 1002, leveling nuts 1010 and threaded leg sections 1004. A back deflector shield 1024 is affixed at an angle to the side cross bars (not shown) and attached to the back support bar (not shown). A top deflector shield 1008 is affixed to the top of the target apparatus structure. As previously explained for FIGS. 1, 2, and 4, the back deflector shield 1024 and top deflector shield 1008 are angled to deflect the projectiles toward the ground and prevent ricocheting.

The pendulum 1040 and single target 1042 in this example are centered on crossbar 1006, however the pendulum 1040 can be off center and multiple targets 1042 can be used.

In FIG. 10 multiple targets 1142 on their respective pendulums 1140 are illustrated. Due to the force exerted by a projectile expelled from a handgun or rifle, the pendulums 1140 and cross bar 1106*a* are not generally removable. In embodiments where the multiple target apparatus 1100 is used for crossbows or bows, the pendulums 1140 and crossbar 1106*a* can be removable.

Figure 12:
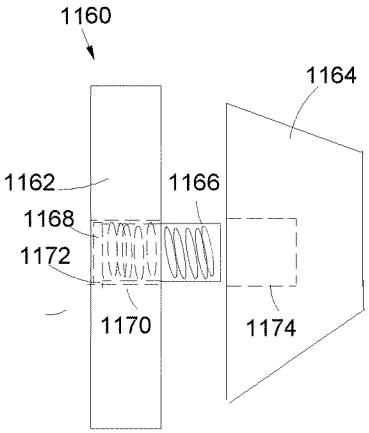
FIG. 12 is an exploded side view of the projection of FIG. 11 and the target face in accordance with the present invention.
Figure 13:
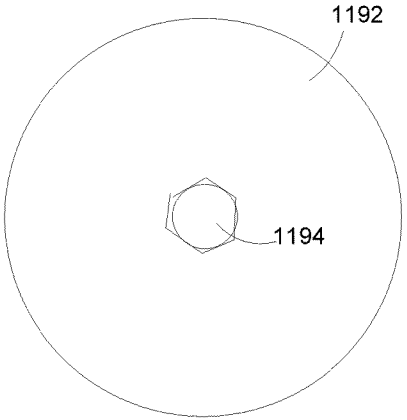
FIG. 13 is an alternate connection for a replaceable projection and target face in accordance with the present invention.
Figure 14:
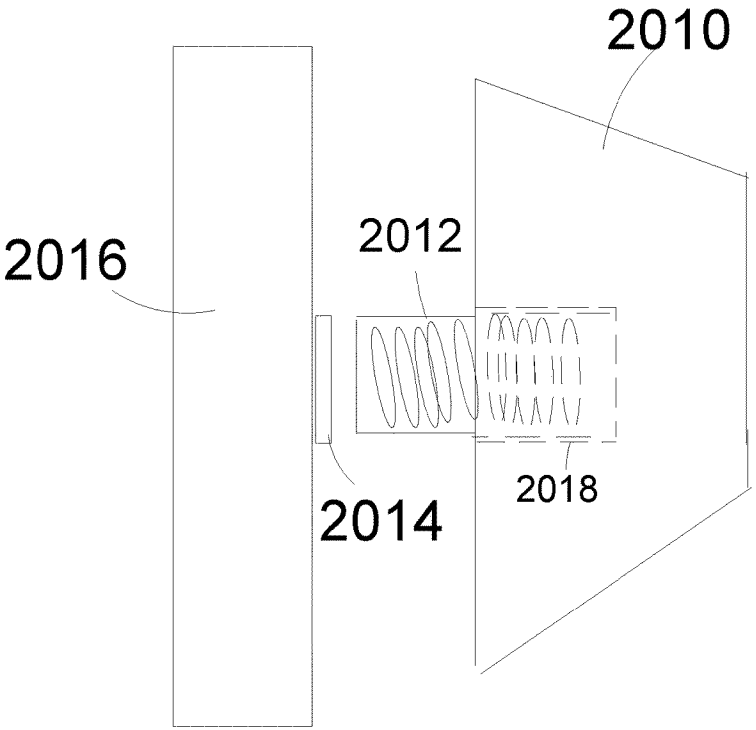
FIG. 14 is another connection method for a replaceable projection and target face in accordance with the present invention.
Figure 15:
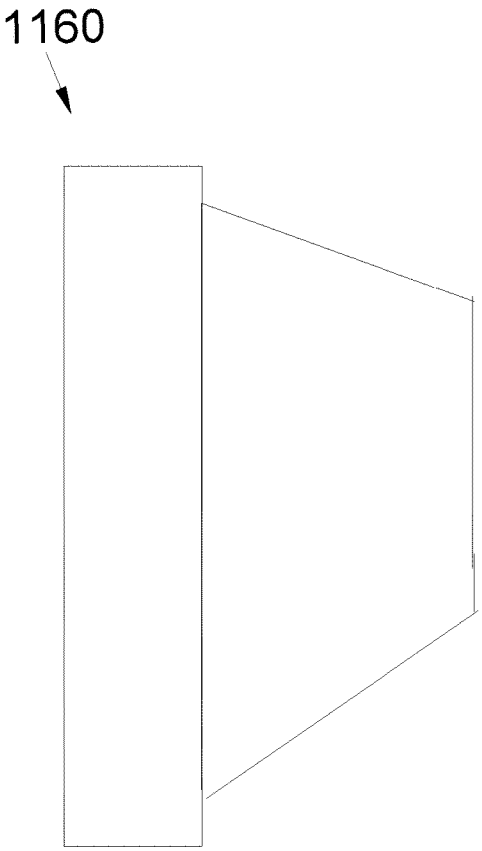
FIG. 15 is a side view of an assembled replaceable projection and target face of FIG. 14 in accordance with the present invention.

In order to vary the weight of the primary targets 142 and 1142, thereby accommodating larger projectiles, the targets 142 and 1142 can be replaced by a multi-piece target as illustrated in FIGS. 11-15. As shown in FIG. 11, a multi-piece target includes at least an interchangeable projection 1164 and a bolt 1168. The multi-piece target 1160 as shown in FIG. 15 consists of a target face 1162 and an interchangeable projection 1164 that can be connected in a variety of ways, some of which are illustrated in FIGS. 12-14. Interchangeable target projection 1164 can made in a variety of weights to accommodate the needs of the user.

In the embodiment of FIG. 12, the target face 1162 has a threaded receiving channel 1170 with a counter sunken entry 1172. The counter sunken entry 1172 and threaded receiving channel 1170 are dimensioned to receive a bolt 1166 that is counter sunk to maintain a flush target face 1162. As will be known to those skilled in the art, the diameter of the bolt 1166 needs to be sufficient to maintain the target face 1162 and the interchangeable projection 1164 as a single unit when struck by a projectile. Additionally, the diameter of the counter sunken entry 1172 must have a diameter sufficient to enable the bolt head 1168 to be tightened using the appropriate tools.

Alternatively, as illustrated in FIG. 13, the head of the bolt 1194 can be welded onto the back of the target face 1192.

In another connection method, illustrated in FIG. 14, the interchangeable projection 2010 has a rod, or bolt, 2012 secured through either threaded or welded into a channel 2018. The threaded end of the rod or bolt 2012 is attached to the target face 2016 by a nut 2014 that has been welded onto the back of the target face 2016.

The threaded channel 1174 within the interchangeable projection 1164 is also dimensioned to receive the bolt 1166, 1194, thereby affixing the interchangeable projection 1164 tightly to the target face 1162, 1192.

These are examples of methods to removably attach the interchangeable projection to the target face and others will be known to those skilled in the art. All of the foregoing methods of connection, as well as others, will produce the target 1160 illustrated in FIG. 15. The ability to change the disclosed interchangeable projections enables users to change out different weights to adjust for different caliber projectiles. Further, as the interchangeable projections can vary in their dimensions, the user can adjust how high the secondary target is launched when the pendulum is impacted. The projections can made from any durable material such as plastic, metal, etc. and have a bolt inside them to screw into a nut that is welded to the back of the target face.

What is claimed is:

1. A multiple target apparatus for projectiles comprising:

a. an open-front structure having:

i. a frame including a plurality of legs connected by a plurality of supports to form an open interior surrounded by a first side, a second side, a third side, and a fourth side wherein said second side is rigidly connected to said first side and said third side is rigidly connected to said second side, and wherein said fourth side comprises an open front;

ii. a target bar suspended from said frame between said first side and said third side configured to support at least one primary target, said primary target having a front and a back;

iii. a top, said top being rigidly connected to at least said first side and said third side, wherein said top is configured to support at least one secondary target;

b. at least one target unit accessible through said fourth side, said target unit including a shaft having said at least one primary target at a first end and a connector at a second end, said connector connecting said target unit to said target bar;

c. at least one secondary target holder securely connected to said top and having sides and open first end and second end, said first end being open to said interior;

d. a projection securely connected to the back of at least one of said at least one primary targets, said projection dimensioned to enter contact the open first end of said at least one secondary target holder;

wherein impact of said primary target by a projectile causes rotation of said shaft to bring said projection in forceable contact with said secondary target within said second target holder, using kinetic energy from impact to launch said secondary target as a moving target; and wherein said open-front structure is configured to securely withstand impact by a projectile without movement.

2. The apparatus of claim 1 further comprising a top deflector securely mounted on said top and being angled to deflect projectiles downward.

3. The apparatus of claim 2 wherein said top deflector is positioned between said at least one secondary target holder and said fourth side.

4. The apparatus of claim 2 wherein said top deflector further comprises sides to provide additional support.

5. The apparatus of claim 1 wherein said first side and said third side are covered to prevent projectiles from exiting said interior.

6. The apparatus of claim 1 further comprising a rear deflector secured to at least said first side and said third side and positioned between incoming projectiles and said second side.

7. The apparatus of claim 6 wherein said rear deflector is angled to direct projectiles downward.

8. The apparatus of claim 6 wherein said rear deflector is further securely affixed to said top.

9. The apparatus of claim 1 wherein is said top is further connected to said second side.

10. The apparatus of claim 1 wherein at least one of said at least one secondary target holder is angled to direct said secondary target toward a user upon impact by said projection.

11. The apparatus of claim 1 wherein said projection is removable from said at least one target.

12. The apparatus of claim 11 wherein said projection is affixed to said at least one target by a bolt.

13. The apparatus of claim 11 wherein at least a second projection having a different weight from said projection is removably connectable to said at least one target to accommodate different projectiles.

14. The apparatus of claim 1 wherein said projection is welded to said at least one target.

15. The apparatus of claim 1 wherein said projection is a frustum configuration.

16. The apparatus of claim 1 wherein said rotation of said shaft is achieved by rotation of said connector around said target bar.

17. The apparatus of claim 1 wherein said rotation of said shaft is achieved by rotation of said target bar.

18. A multiple target apparatus for projectiles comprising:

a. an open-front structure having:

i. a frame including a plurality of legs connected by a plurality of supports to form an open interior surrounded by a first side, a second side, a third side, and a fourth side wherein said second side is rigidly connected to said first side and said third side is rigidly connected to said second side, and wherein said fourth side comprises an open front;

ii. a target bar suspended from said frame between said first side and said third side configured to support at least one primary target, said primary target having a front and a back;

ili. a top, said top being rigidly connected to at least said first side and said third side, wherein said top is configured to support at least one secondary target;

iv. a rear deflector secured to and positioned between at least said first side and said third side, said rear deflector being positioned at an angle to direct projectiles downward;

v. a top deflector securely mounted on said top between said at least one secondary target holder and said fourth side, said top deflector being angled to deflect projectiles downward and having sides to provide support;

b. at least one target unit accessible through said fourth side, said target unit including a shaft having said at least one primary target at a first end and a connector at a second end, said connector rotationally connecting said target unit to said target bar and maintained in position on said target bar by spacers;

c. at least one secondary target holder securely connected to said top and having sides and open first end and second end, said first end being open to said interior, wherein said secondary target holder is angled to direct said secondary target toward a user;

d. a frustrum projection securely connected to the back of at least one of said at least one primary targets, said projection dimensioned to enter the open first end of said at least one secondary target holder;

wherein impact of said primary target by a projectile causes rotation of said shaft to bring said projection in forceable contact with said secondary target within said second target holder, using kinetic energy from impact to launch said secondary target as a moving target; and wherein said open-front structure is configured to securely withstand impact by a projectile without movement.

19. The apparatus of claim 18 wherein said projection is removable from said at least one target, and wherein at least a second projection having a different weight from said projection is removably connectable to said at least one target to accommodate different projectiles.

20. A method of shooting stationary and moving targets using a multiple target apparatus for projectiles comprising:

a. a multiple target apparatus for projectiles comprising:

b. an open-front structure having:

i. a frame including a plurality of legs connected by a plurality of supports to form an open interior surrounded by a first side, a second side, a third side, and a fourth side wherein said second side is rigidly connected to said first side and said third side is rigidly connected to said second side, and wherein said fourth side comprises an open front;

ii. a target bar suspended from said frame between said first side and said third side configured to support at least one primary target, said primary target having a front and a back;

iii. a top, said top being rigidly connected to at least said first side and said third side, wherein said top is configured to support at least one secondary target;

iv. a rear deflector secured to and positioned between at least said first side and said third side, said rear deflector being positioned at an angle to direct projectiles downward;

v. a top deflector securely mounted on said top between said at least one secondary target holder and said fourth side, said top deflector being angled to deflect projectiles downward and having sides to provide support;

c. at least one target unit accessible through said fourth side, said target unit including a shaft having said at least one primary target at a first end and a connector at a second end, said connector rotationally connecting said target unit to said target bar;

d. at least one secondary target holder securely connected to said top and having sides and open first end and second end, said first end being open to said interior, wherein said secondary target holder is angled to direct said secondary target toward a user;

e. a frustrum projection securely connected to the back of at least one of said at least one primary targets, said projection dimensioned to enter contact the open first end of said at least one secondary target holder;

f. comprising the steps of:

i. impacting said at least one primary target by a projectile;

ii. rotating said shaft by impact to said projectile;

iii. bringing said projection in forceable impact with said at least one secondary target;

iv. using kinetic energy from impact to launch said secondary target within said second target holder into the air to create a moving target;

v. impacting said secondary target while in the air.

* * * * *